US006215237B1

(12) United States Patent
Tsuchida et al.

(10) Patent No.: US 6,215,237 B1
(45) Date of Patent: Apr. 10, 2001

(54) COLOR CATHODE RAY TUBE WITH SHADOW MASK HAVING MASK FRAME BALANCED IN MECHANICAL STRENGTH

(75) Inventors: Shigeru Tsuchida; Takashi Murai, both of Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/123,468

(22) Filed: Jul. 28, 1998

(30) Foreign Application Priority Data

Jul. 29, 1997 (JP) ..... 9-203363

(51) Int. Cl.[7] ..... H01J 29/80
(52) U.S. Cl. ..... 313/402; 313/407
(58) Field of Search ..... 313/402, 404, 313/405, 406, 407, 408

(56) References Cited

U.S. PATENT DOCUMENTS

| | | | | |
|---|---|---|---|---|
| 4,692,660 | | 9/1987 | Adler et al. . | |
| 4,866,334 | | 9/1989 | Fendley et al. . | |
| 5,248,914 | * | 9/1993 | Capek et al. | 313/402 |
| 5,550,428 | * | 8/1996 | Kume et al. | 313/402 |
| 5,742,116 | * | 4/1998 | Maki et al. | 313/402 |

FOREIGN PATENT DOCUMENTS 0 143 938 6/1985 (EP) .
0 211 963 3/1987 (EP) .

OTHER PUBLICATIONS

Patent Abstracts of Japan, vol. 14, No. 239 (E–0930), May 21, 1990, JP 2–065036, Mar. 5, 1990.
Patent Abstracts of Japan, vol. 14, No. 9 (E–870), Jan. 10, 1989, JP 1–255134, Oct. 12, 1989.

* cited by examiner

*Primary Examiner*—Nimeshkumar D. Patel
*Assistant Examiner*—Todd Reed Hopper
(74) *Attorney, Agent, or Firm*—Oblon, Spivak, McClelland, Maier & Neustadt, P.C.

(57) ABSTRACT

A shadow mask is provided in an envelope of a color cathode ray tube. The shadow mask includes a mask body having a number of electron beam apertures, and a mask frame having side walls equipped on the peripheral portion of the mask body. The side walls of the mask frame includes a pair of long side walls extending in parallel with the long axis X and a pair of short side walls extending in parallel with the short axis Y. Beads and are respectively formed on the long side walls and the short side walls. The length of each bead of the long side wall along the long axis is set in a range of 55% to 80% of the length of the long side walls along the long axis, and a width of the bead in the tube axis direction is set in a rage of 40% to 75% of the maximum width of the long side walls in the tube axis direction. The length of each bead of the short side wall along the short axis is set in a range of 55% to 80% of the length of the short side walls along the short axis, and a width of the bead in the tube axis direction is set in a rage of 40% to 75% of the maximum width of the short side walls in the tube axis direction.

10 Claims, 3 Drawing Sheets

COLOR CATHODE RAY TUBE WITH SHADOW MASK HAVING MASK FRAME BALANCED IN MECHANICAL STRENGTH

BACKGROUND OF THE INVENTION

The present invention relates to a color cathode ray tube.

In general, a color cathode ray tube comprises an envelope. The envelope has a substantially rectangular panel provided with a skirt portion at the peripheral portion of an effective surface of a curved surface, and a funnel joined with the skirt portion. On the inner surface of the panel is formed a phosphor screen which includes light absorbing layers and three-color phosphor layers formed at gaps between the light absorbing layers. An electron gun is arranged in the neck of the funnel and a deflector is mounted on the funnel. Further, a substantially rectangular shadow mask is provided in the envelope to be opposed to the phosphor screen.

In this color cathode ray tube, three electron beams emitted from the electron gun are deflected by the deflector and horizontally and vertically scan the phosphor screen through electron beam apertures of the shadow mask, thereby to display a color image.

In general, a shadow mask is comprised of a substantially rectangular mask body and a substantially rectangular mask frame. The mask body has a main surface portion consisting of a curved surface opposed to the phosphor screen and having a number of electron beam apertures formed therein, and a skirt portion provided at the peripheral edge of the main surface portion. The mask frame has side walls contacting with and welded to the skirt portion of the mask body.

With one of methods of supporting the shadow mask, substantially wedge-like elastic support members are fixed to the side walls at the corners of the mask frame, and the support members are engaged with stud pins provided at the skirt portion of the corners of the panel, thereby detachably supporting the shadow mask on the inside of the panel.

In the color cathode ray tube as described above, three electron beams which have passed the electron beam apertures of the mask body must properly land on the three color phosphor layers, respectively, in order to display an image without color deviation. Therefore, it is necessary to arrange the shadow mask at a proper alignment relationship with respect to the panel.

Recently, in a color cathode ray tube such as a display tube used in a terminal apparatus of a computer in response to introduction of multi-media, the arrangement pitch of three color phosphor layers is reduced in comparison with a normal color cathode ray tube, to improve the resolution, and therefore, the margin rate for beam landing is so small that color deviation easily occurs. Accordingly, more precise beam landing is required.

However, actually, in steps of manufacturing a color cathode ray tube, the shadow mask is repeatedly attached to and detached from the panel, and during the attaching and detaching operations, a stress applied on the shadow mask causes the mask frame to be distorted. The distortion of the mask frame further causes the mask body to be distorted, and as a result, beam landing is shifted from the predetermined three color phosphor layers, thereby causing color deviation.

In addition, in the cathode ray tube as described above, since the margin rate for beam landing is small, it is necessary to reduce the position shifting of the shadow mask caused by any external impact as much as possible. To reduce the position shifting of the shadow mask caused by an external impact, it is also necessary to reduce loads acting on the elastic support member itself. However, if the weight of the mask frame itself is decreased to reduce loads on the elastic support member, the mechanical strength of the shadow mask against a stress applied thereto when attaching and detaching the shadow mask in steps of manufacturing a color cathode ray tube is lowered. As a result, the position shifting of the shadow mask is caused with respect to the panel.

Further, with respect to the shadow mask, in order to prevent unevenness of a formed phosphor screen, the mask body is thinned so as to reduce variations of the shapes and sizes of the electron beam apertures of the mask body, thereby reducing unevenness of the phosphor screen due to variations of the electron beam apertures. However, if the mask body is thinned, the mechanical strength thereof decreases and tends to be deformed easily.

Also, the shadow mask is heated by collisions of electron beams and expands, causing doming. In a shadow mask formed of a low expansion-coefficient material such as invar which efficiently restricts registration of beam landing caused by the doming, a mask frame provided with a convex portion (or bead portion) has been proposed as a counter measure against deformation.

However, not only the mask frame of a conventional shadow mask but also the mask frame having the convex portion as described above is short of suitable mechanical strength and cannot respond sufficiently to variations of mask frames in manufacturing steps and deformation in assembling shadow masks.

BRIEF SUMMARY OF THE INVENTION

The present invention has been contrived in consideration of the above circumstances and its object is to provide a color cathode ray tube, which has an improved mechanical strength without increasing the weight of the mask frame and which can reduces mislanding of electron beams due to deformation of the mask frame.

To achieve the object described above, a color cathode ray tube according to the present invention comprises: an envelope including a substantially rectangular panel having an inner surface on which a phosphor screen is formed; a substantially rectangular shadow mask arranged in the envelope to oppose the phosphor screen; and an electron gun provided in the envelope, for emitting electron beams to the phosphor screen through the shadow mask.

The shadow mask includes a substantially rectangular mask body having a main surface portion provided with a number of electron beam apertures and opposing the phosphor screen, and a substantially rectangular mask frame having side walls attached to an peripheral edge portion of the mask body. The mask frame includes a long axis and a short axis perpendicular to each other, and perpendicularly crossing a tube axis, and the side walls of the mask frame includes a pair of long side walls extending in parallel with the long axis and a pair of short side walls extending in parallel with the short axis.

At least one of the long and short side walls has a bead. The length of the beads in a direction perpendicular of the tube axis is set in a range of 55% to 80% of a length of the at least one of the long and short side walls in the direction of the long axis, and a width of the beads in a direction of the tube axis is set in a range of 40% to 75% of a maximum width of the at least one of the long and short side walls in the direction of the tube axis.

Since the side walls of the mask frame are provided with beads, and the length and width of each bead are set to a proper size matched with the side wall, the mechanical strength of the shadow mask can be improved. Accordingly, deformation of the mask body and changes of the positional relationship between the panel and the shadow mask can be effectively prevented, so that it is possible to construct a color cathode ray tube which is difficult to cause misregistration of beam landing with respect to the phosphor layers.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

FIGS. 1 to 3C show a cathode ray tube according to an embodiment of the present invention, in which:

FIG. 1 is a longitudinal cross-sectional view showing the color cathode ray tube;

FIG. 2 is a perspective view schematically showing a phosphor screen, a shadow mask, and an electron gun of the color cathode ray tube;

FIG. 3C is a cross-sectional view taken along a line IIIC—IIIC in FIG. 3A;

DETAILED DESCRIPTION OF THE INVENTION

In the following, a color cathode ray tube according to an embodiment of the present invention will be described in detail with reference to the drawings.

Figure 1:
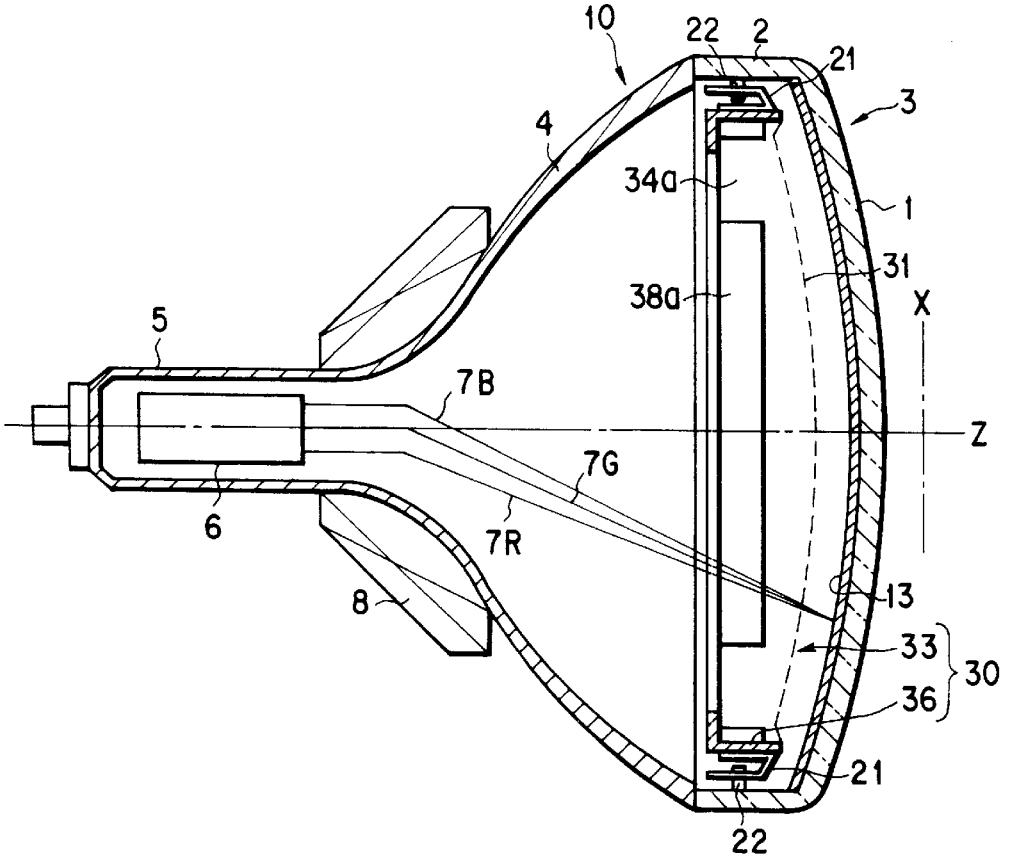
Figure 2:
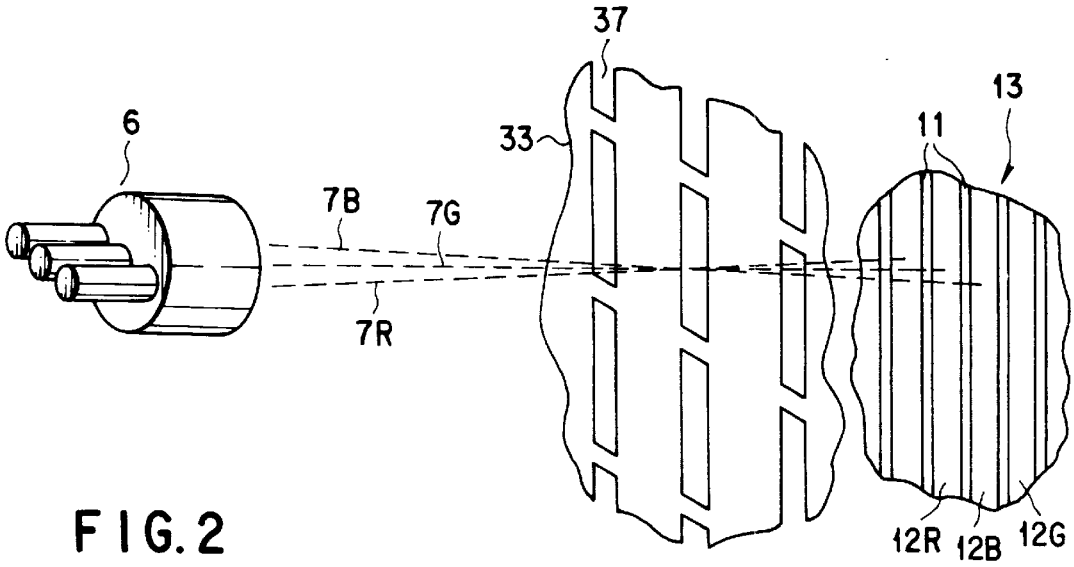

As shown in FIGS. 1 and 2,a color cathode ray tube comprises a vacuum envelope 10, and the vacuum envelope comprises a substantially rectangular panel 3 having an effective surface 1 in a form of a curved surface and a skirt portion 2 standing on the peripheral edge portion of the effective surface, and a funnel 4 joined to the skirt portion of the panel. A phosphor screen 13 is formed on the inner surface of the panel 3, and the screen includes a number of strip-like light-absorbing layers 11, three-color phosphor layers 12R, 12G, and 12B embedded between the strip-like light-absorbing layers 11 for emitting light in blue, green, and red. Also, a substantially rectangular shadow mask 30 described later is arranged in the envelope 10 to oppose the phosphor screen 13 with a predetermined distance.

An electron gun 6 for emitting three electron beams 7B, 7G, and 7R is arranged in a neck 5 of the funnel 4. In addition, a deflector 8 is equipped outside the funnel 4. In the color cathode ray tube having the construction mentioned above, three electron beams 7B, 7G, and 7R emitted from the electron gun 6 are deflected by the deflector 8 and horizontally and vertically scan the phosphor screen 13 through the shadow mask 30, thereby displaying a color image on the phosphor screen.

Figure 3A:
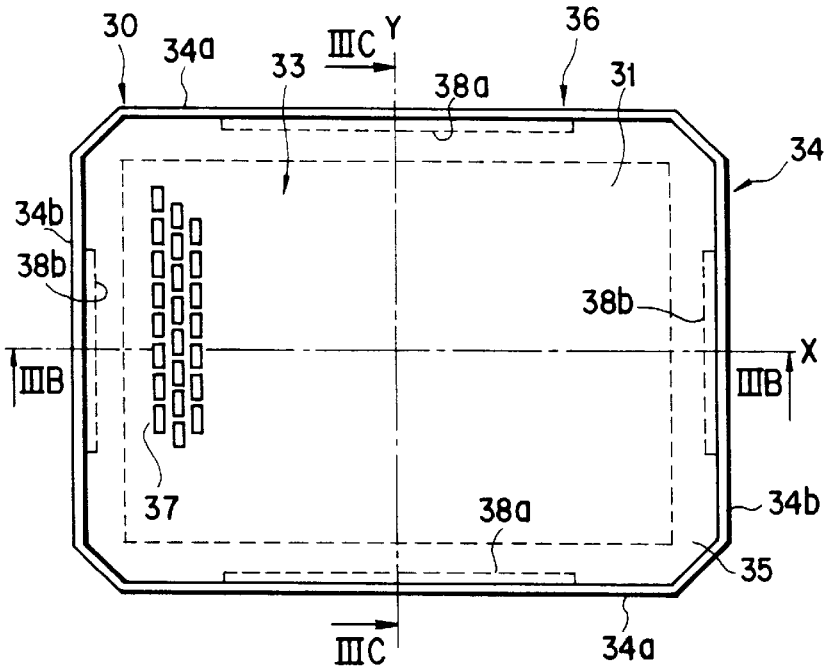
FIG. 3A is a plan view of the shadow mask.
Figure 3C:
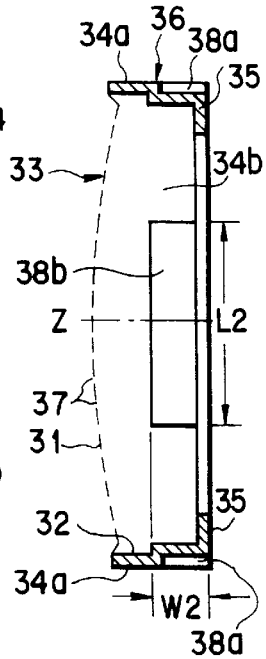
Figure 3B:
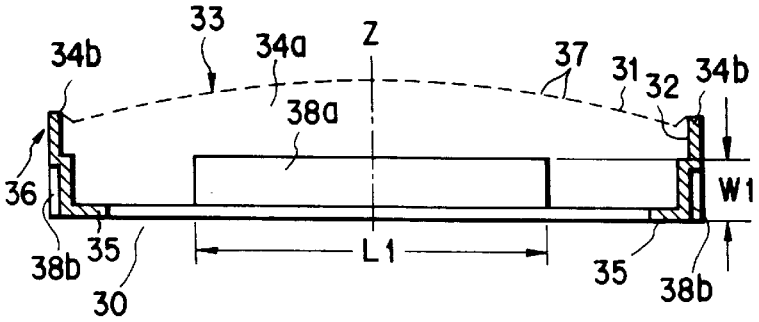
FIG. 3B is a cross-sectional view taken along a line IIIB—IIIB in FIG. 3A.

As shown in FIGS. 3A to 3C, the shadow mask 30 comprises a substantially rectangular mask body 33 and a substantially rectangular mask frame 36 supporting the periphery of the mask body. The mask body 33 has a substantially rectangular main surface portion 31 formed of a curved surface opposing the phosphor screen 13, and a skirt portion 32 extending from the peripheral edge of the main surface portion 31. A number of electron beam apertures 37 are formed in the main surface portion 31.

The mask frame 36 includes four side walls 34 each of which has an extending portion 35 extending from an end there and has a L-shaped cross-section. The mask body 33 is fixed to the mask frame 36 by welding the skirt portion 32 to the inner surface of the side walls 34 of the mask frame 36.

According to the present embodiment, the shadow mask 30 includes beads formed in the respective side walls 34 of the mask frame 36 and projecting insides the mask frame.

Specifically, the mask body 33 and the mask frame 36 have a long axis (or X-axis) and a short axis (or Y-axis) which are cross each other at right angles and perpendicular to a tube axis Z. The side walls 34 of the mask frame 36 are formed of a pair of long side walls 34*a* extending in parallel with the long axis X and a pair of short side walls 34*b* extending in parallel with the short axis Y. Further, a bead 38*a* is formed at the center portion of each of the long side walls 34*a* and extends in a direction parallel to the long axis X, and a bead 38*b* is formed at the center portion of each of the short side walls 34*b* and extends in a direction parallel to the short axis Y.

The length L1 of each bead 38*a* in the direction of the long axis X is set in a range of 55% to 80% of the length of each long side wall 34*a* in the direction of the long axis X. Likewise, the length L2 of each bead 38*b* is set in a range of 55% to 80% of the length of each short side wall 34*b* in the direction of the short axis Y. The width W1 of each bead 38*a* in the direction of the tube axis Z is set in a range of 40% to 75% of the maximum width of each long side wall 34*a* in the direction of the tube axis Z, and the width W2 of each bead 38*b* in the direction of the tube axis Z is set in a range of 40% to 75% of the maximum width of each short side wall 34*b* in the direction of the tube axis Z.

The shadow mask 30 constructed in the structure as described above is detachably supported on the inside of the panel 3, in a manner such that substantially wedge-shaped elastic support members 21 provided at corners of the mask frame 36 are respectively engaged with stud pins 22 erected on the inner surfaces of the corners of the skirt portion 2 of the panel 3.

According to the color cathode ray tube constructed as described above, by providing the beads 38*a* and 38*b* at the side walls 34*a* and 34*b* of the mask frame 36 fixed to the mask body 33, the mechanical strength of the shadow mask 30 can be increased even when the weight of the mask frame 36 is reduced. Therefore, an unnecessary unbalanced stress is not applied to the mask body 33 when assembling. the shadow mask 30, so that deformation of the mask body 33 can be prevented. In addition, deformation of the mask frame 36 can be reduced against a stress applied when the shadow mask 30 is attached to and detached from the panel 3 in the steps of manufacturing the color cathode ray tube. As a result of this, deformation of the mask body 33 and changes of the positional relationship between the panel 3 and the shadow mask 30 can be effectively prevented, and it is therefore possible to construct a color cathode ray tube which is difficult to cause mislanding of electron beams on the three-color phosphor layers 12R, 12G, and 12B.

With respect to the shadow mask 30 in which the bead 38*a* and 38*b* are provided at the four side wall 34*a* and 34*b* of the mask frame 36, studies and discussions were made to the relationship between the lengths L1 and L2 and widths W1 and W2 of the beads 38*a* and 38*b,* and deformation amounts in the direction of the tube axis Z and in the direction perpendicular to the tube axis when stresses such as bending and twisting are applied to the long side walls 34*a* and short side walls 34*b* of the mask frame 36. The results shown in the following tables 1 and 2 were obtained.

TABLE 1

| | LENGTH | | | | | |
|---|---|---|---|---|---|---|
| | NO BEADS | DIRECTION PERPENDICULAR TO TUBE AXIS APPLOX. 25% | DIRECTION PERPENDICULAR TO TUBE AXIS APPLOX. 50% | DIRECTION PERPENDICULAR TO TUBE AXIS APPLOX. 65% | DIRECTION PERPENDICULAR TO TUBE AXIS APPLOX. 75% | DIRECTION PERPENDICULAR TO TUBE AXIS APPLOX. 85% |
| BENDING OF LONG SIDE | 22.7 | 10.4 | 6.8 | 4.6 | 2.5 | 0.1 |
| BENDING OF SHORT SIDE | 13.5 | 6.5 | 3.7 | 3.4 | 3.8 | 4.2 |
| TWISTING | 0.03 | 0.18 | 0.1 | 0.07 | 0.08 | 0.12 |
| LOAD TO CORNERS OF SIDE WALL | 0.17 | 0.17 | 0.07 | 0.05 | 0.03 | 0.01 |

TABLE 2

| WIDTH | NO BEADS | TUBE AXIS DIRECTION APPLOX. 25% | TUBE AXIS DIRECTION APPLOX. 40% TO 75% | TUBE AXIS DIRECTION APPLOX. 85% |
|---|---|---|---|---|
| BENDING OF LONG EDGE | 22.7 | 4.9 | 4.0 | 0.1 |
| BENDING OF SHORT EDGE | 13.5 | 5.1 | 4.3 | 6.1 |
| TWISTING | 0.03 | 0.08 | 0.11 | 0.14 |
| LOAD TO CORNER SIDE WALL PORTIONS | 0.17 | 0.06 | 0.04 | 0.01 |

Among the deformation amounts shown in Tables 1 and 2, those of the "bending of long side" show deformation amounts of the mask frame 34 where a stress in the direction of the tube axis Z is applied to the extending portion 35 of the long side wall 34*a,* those of the "bending of short side" show deformation amounts of the mask frame 34 where a stress in the direction of the tube axis Z is applied to the extending portion 35 of the short side wall 34*b,* those of the "twisting" show deformation amounts of the mask frame where stresses in the directions opposite to each other are respectively applied to the extending portion 35 of each long side wall 34*a* and the extending portion 35 of each short side wall 34*b,* and those of the "load onto corners of side walls" show deformation amounts of the mask frame where a stress in the diagonal direction is applied to the side walls. The amounts of the "load onto corners of side walls" indicates the maximum deformation amount of the portion to which the mask body 33 is to be attached.

As seen from the Table 1, when the length L1 and L2 of the beads 38*a* and 38*b* are set in a range of 50% to 85% of the length of each long side wall 34*a* and each short side wall 34*b* in the direction perpendicular to the tube axis Z, unbalance between the deformation amounts of the bending of long side and the bending of short side can be reduced, and the deformation amounts of the long and short side walls can be made substantially equal to each other. With respect to twisting and load onto corners of side walls, the deformation amount of the mask frame can be reduced.

It is more preferable that the length L1 and L2 are set in a range of 55% to 80%, wherein unbalance of the deformation amounts of the shadow mask can be further reduced and the shadow mask can be stable at a small deformation.

As shown in Tables 1 and 2, the mask frame having no beads has much higher deformation amounts of the bending of the long and short sides than the mask frame provided with beads. Hence, it can be understood that the mechanical strength of the mask frame is improved by providing the beads 38*a* and 38*b* and the deformation of the mask frame can be greatly reduced.

In case of the mask frame having no beads, the deformation amount of the bending of the long side is greater than that of the bending of the short side, due to the difference in length between the long and short side walls. However, according to the present embodiment, unbalance between the bending of the long side and the bending of the short side of the mask frame is improved and the deformation amounts of the long and short side walls can be substantially equalized to each other, where the lengths L1 and L2 of the beads 38*a* and 38*b* of the long and short side walls 34*a* and 34*b* are set in a range of 55% to 80% of the lengths of the long and short side walls, respectively, and where the widths W1 and W2 of the beads 38*a* and 38*b* in the direction of the tube axis Z are set in a range of 40% to 75% of the maximum widths of the long and short side walls, respectively. Therefore, if uneven stresses are applied to the long and short side walls, the stress applied to the long and short sides of the mask body 33 can be made substantially even so that deformation of the mask body can be reduced.

As described above, according to the color cathode ray tube, the mechanical strength of the shadow mask 30 can be improved, so that an unbalanced unnecessary stress is not applied to the mask body 33 and deformation of the shadow mask can be prevented even if the weight of the mask frame 36 and the like is reduced. Accordingly, deformation of the mask body 33 and changes of the positional relationship between the panel 3 and the shadow mask 30 can be effectively prevented, so that it is possible to provide a color cathode ray tube of excellent quality which is difficult to cause misregistration of beam landing on the three-color phosphor layers.

Figure 4A:
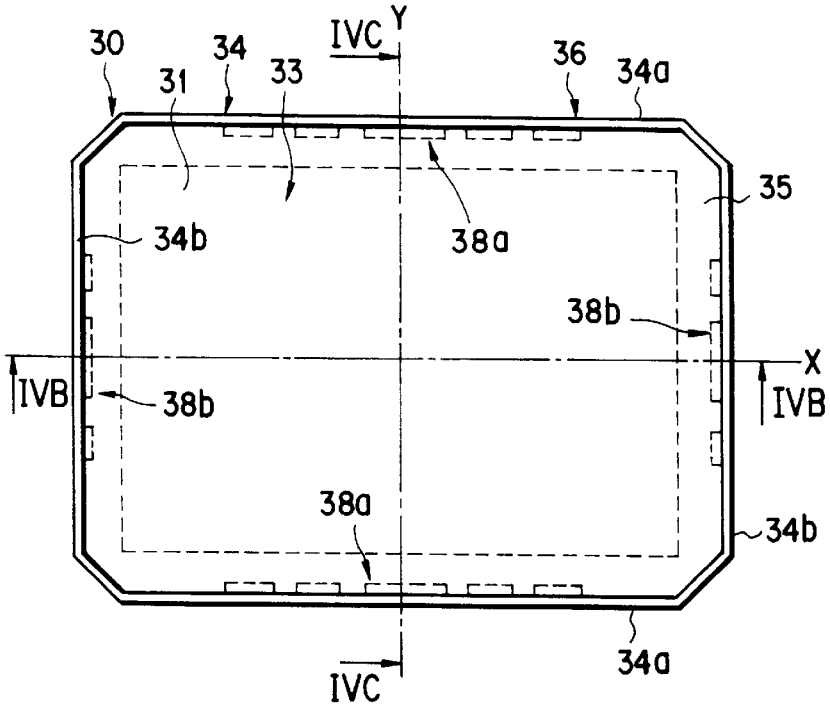
FIG. 4A is a plan view of a shadow mask according to a modification of the present invention.
Figure 4C:
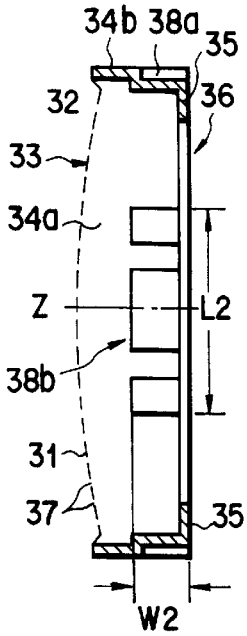
FIG. 4C is a cross-sectional view taken along a line IVC—IVC in FIG. 4A.
Figure 4B:
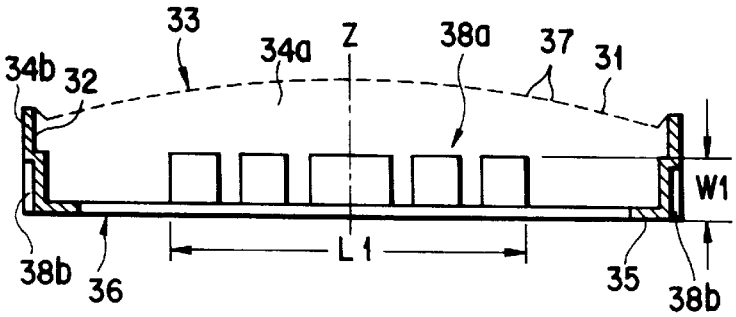
FIG. 4B is a cross-sectional view taken along a line IVB—IVB in FIG. 4A.

Note that the present invention is not limited to the above mentioned embodiment but can be variously modified within the scope of the invention. For example, in the embodiment described above, one bead 38*a* is provided for each of the long side walls 34*a* and one bead 38*b* is provided for each of the short side walls. However, as shown in FIGS. 4A to 4C, each of the beads 38*a* and 38*b* may be divided into a plurality of bead sectors which are disposed in parallel with relatively narrow intervals. In this case, the distances between those bead sectors positioned at both ends in their lengthwise directions are set to the lengths L1 and L2. The width of each of the bead sectors is set to the width W1 or W2.

In case where each of the beads 38 is constituted by a plurality of bead sectors, the lengths of the bead sectors may differ from each other, as shown in FIGS. 4A to 4C.

Also, in the above embodiment, the beads 38 are defined by projecting inwards part of each side wall of the mask frame. However, each bead may be formed by projecting outwards a part of each side wall.

Further, in the above embodiment, the side walls 34 is provided with beads extending in the direction toward the mask body 33 from the side of the extending portion 35. The bead portions, however, may be provided so as to extend toward the extending portion 35 from intermediate portions of the side walls or end portions on the mask body side.

In the above embodiment, beads are provided at both long and short side walls of the mask frame.

However, beads may be provided at only one of the long and short side walls.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed:

1. A color cathode ray tube comprising:

an envelope including a substantially rectangular panel having an inner surface on which a phosphor screen is formed;

a-substantially rectangular shadow mask provided in the envelope and opposing the phosphor screen; and an electron gun arranged in the envelope, for emitting an electron beam to the phosphor screen through the shadow mask;

the shadow mask including a substantially rectangular mask body having a main surface portion opposed to the phosphor screen and provided with a number of electron beam apertures, and a substantially rectangular mask frame having side walls attached to the mask body and being in contact with a peripheral portion of the mask body, the mask frame including a long axis and a short axis perpendicular to each other and perpendicularly crossing a tube axis, and the side walls of the mask frame including a pair of long side walls extending in parallel with the long axis and a pair of short side walls extending in parallel with the short axis, at least one of the long and short side walls having beads, each formed by projecting a part of each side wall of the mask frame, a length of the beads in a direction perpendicular of the tube axis being set in a range of 55% to 80% of a length to the at least one of the long and short side walls in the direction of the long axis, and a width of the beads in a direction of the tube axis being set in a range of 40% to 75% of a maximum width of the at least one of the long and short side walls in the direction of the tube axis so that, when stresses are applied to the mask frame, unbalance between bending of the long sides and bending of the short sides of the mask frame is improved and deformation amounts of the long and short side walls are substantially equalized to each other.

2. A color cathode ray tube according to claim 1, wherein each of the beads includes a plurality of bead sectors disposed with an interval between each other.

3. A color cathode ray tube according to claim 2, wherein the plurality of bead sectors have lengths different from each other.

4. A color cathode ray tube according to claim 1, wherein the mask frame has an extending portion projecting toward an inside of the mask frame from an end edge of each of the side walls in the direction of the tube axis, and a L-shaped cross-section, the mask body is attached to another end edges of the side walls in the direction of the tube axis, and each of the beads extends from the side on the extending portion toward the mask body.

5. A color cathode ray tube according to claim 1, further comprising a stud pin projecting from the panel, and an elastic support member equipped on the mask frame and elastically supporting the shadow mask through the stud pin.

6. A color cathode ray tube comprising:

an envelope including a substantially rectangular panel having an inner surface on which a phosphor screen is formed;

a substantially rectangular shadow mask provided in the envelope and opposing the phosphor screen, and an electron gun arranged in the envelope, for emitting an electron beam to the phosphor screen through the shadow mask;

the shadow mask including a substantially rectangular mask body having a main surface portion opposed to the phosphor screen and provided with a number of electron beam apertures, and a substantially rectangular mask frame having side walls attached to the mask body and being in contact with a peripheral portion of the mask body, the mask frame including a long axis and a short axis perpendicular to each other and perpendicularly crossing a tube axis, and the side walls of the mask frame including a pair of long side walls extending in parallel with the long axis and a pair of short side walls extending in parallel with the short axis, the long and short side walls having beads, respectively, each of the beads being a projection of a part of a respective side wall of the mask frame, a length of the beads of the long side walls in the direction of the long axis being set in a range of 55% to 80% of a length of the long side walls in the direction of the long axis, and a width of the beads in a direction of the tube axis being set in a range of 40% to 75% of a maximum width of the long side walls in the direction of the tube axis, and a length of the beads of the short side walls in the direction of the short axis being set in a range of 55% to 80% of a length of the short side walls in the direction of the short axis, and a width of the beads in a direction of the tube axis being set in a range of 40% to 75% of a maximum width of the short side walls in the direction of the tube axis so that, when stresses are applied to the mask frame, unbalance between bending of the long sides and bending of the short sides of the mask frame is improved and deformation amounts of the long and short side walls are substantially equalized to each other.

7. A color cathode ray tube according to claim 6, wherein each of the beads includes a plurality of bead sectors disposed with an interval between each other.

8. A color cathode ray tube according to claim 7, wherein the plurality of bead sectors have lengths different from each other.

9. A color cathode ray tube according to claim 6, wherein the mask frame has an extending portion projecting toward an inside of the mask frame from first end edges of each of the side walls in the direction of the tube axis, and a L-shaped cross-section, the mask body is attached to second end edges of the side walls in the direction of the tube axis, and each of the beads extends from the side on the extending portion toward the mask body.

10. A color cathode ray tube comprising:

an envelope including a substantially rectangular panel having an inner surface on which a phosphor screen is formed;

a substantially rectangular shadow mask provided in the envelope and opposing the phosphor screen; and an electron gun arranged in the envelope, for emitting an election beam to the phosphor screen through the shadow mask;

the shadow mask including a substantially rectangular mask body having a main surface portion opposed to the phosphor screen and provided with a number of electron beam apertures, and a substantially rectangular mask frame having side walls attached to the mask body and being in contact with a peripheral portion of the mask body, the mask frame including a long axis and a short axis perpendicular to each other and perpendicularly crossing a tube axis, and the side walls of the mask frame including pair of long side walls extending in parallel with the long axis and a pair of short side walls extending in parallel with the short axis, at least one of the long and short side walls having beads, a length of the beads in a direction perpendicular to the tube axis being set in a range of 55% to 80% of a length of the at least one of the long and short side walls in the direction of the long axis, and a width of the beads in a direction of the tube axis being set in a range of 40% to 75% of a maximum width of the at least one of the long and short side walls in the direction of the tube axis;

each of the beads including a plurality of bead sectors which are disposed with an interval between each other and which have lengths different from each other.

* * * * *